US005564499A

United States Patent [19]

Willis et al.

[11] Patent Number: 5,564,499

[45] Date of Patent: Oct. 15, 1996

[54] METHOD AND DEVICE FOR SLOTTING WELL CASING AND SCORING SURROUNDING ROCK TO FACILITATE HYDRAULIC FRACTURES

[76] Inventors: Roger B. Willis, 909 Fairview Ave., Meadville, Pa. 16335; Phillip M. Halleck, 102 Nea'Yu'Ka St., Port Matilda, Pa. 16870; William P. Stoner, 34 Dogwood Estates, Home, Pa. 15747

[21] Appl. No.: 418,377

[22] Filed: Apr. 7, 1995

[51] Int. Cl.[6] ..... E21B 29/02; E21B 43/117; E21B 43/26

[52] U.S. Cl. ..... 166/299; 166/63; 166/308; 175/4.51; 175/4.6

[58] Field of Search ..... 166/299, 63, 308, 166/298, 297, 55; 175/4.51, 4.56, 4.6; 102/308, 313

[56] References Cited

U.S. PATENT DOCUMENTS

| | | | |
|---|---|---|---|
| 2,758,543 | 8/1956 | Grandin | 175/4.6 |
| 3,058,521 | 10/1962 | Gilbert | 166/308 |
| 3,280,913 | 10/1966 | Smith | 166/308 X |
| 3,313,348 | 4/1967 | Huitt et al. | 166/308 X |
| 3,734,018 | 5/1973 | Gillingham | 102/313 |
| 4,106,561 | 8/1978 | Jerome et al. | 166/55.2 |
| 4,160,412 | 7/1979 | Snyer et al. | 166/63 X |
| 4,329,925 | 5/1982 | Hane et al. | 166/63 X |
| 4,378,845 | 4/1983 | Medlin et al. | 166/297 |
| 4,534,423 | 8/1985 | Regalbuto | 175/4.6 |
| 4,676,309 | 6/1987 | Gonzalez | 166/55 |
| 4,753,301 | 6/1988 | Berry | 175/4.6 |
| 4,768,597 | 9/1988 | Lavigne et al. | 175/451 |
| 4,881,445 | 11/1989 | Hayes | 89/1.15 |
| 5,007,486 | 4/1991 | Ricles | 175/4.6 |
| 5,036,771 | 8/1991 | Alford | 102/307 |
| 5,131,472 | 7/1992 | Dees et al. | 166/308 |
| 5,273,121 | 12/1993 | Kitney et al. | 175/4.51 |
| 5,295,545 | 3/1994 | Passamaneck | 166/299 |
| 5,335,724 | 8/1994 | Venditto et al. | 166/298 |
| 5,366,015 | 11/1994 | Surjaatmadja et al. | 166/298 |

OTHER PUBLICATIONS

Hallam and Last "Geometry of Hydraulic Fractures from Modestly Deviated Wellbores" J. Petroleum Technology, Jun. 1991, pp. 742–748.

Pearson, et al "Results of Stress–Oriented and Aligned Perforating in Fracturing Deviated Wells" J. Petroleum Technology, Jan. 1992, pp. 10–18.

Behrmann and Eibel "Effect of Perforations on Fracture Initiation", J. Petroleum Technology, May 1991, pp. 608–615.

*Primary Examiner*—Stephen J. Novosad

*Attorney, Agent, or Firm*—William L. Krayer

[57] ABSTRACT

Linear apertures are created in well casing through the use of linear charges lowered into the well casing in place; hydraulic fracturing conducted through the linear apertures achieves larger and less dissipated fractures than conventional small circular perforations which generate near well bore tortuosity. The linear charges can also be used in open bores and in overbalance perforating.

19 Claims, 5 Drawing Sheets

METHOD AND DEVICE FOR SLOTTING WELL CASING AND SCORING SURROUNDING ROCK TO FACILITATE HYDRAULIC FRACTURES

TECHNICAL FIELD

This invention relates to a method and apparatus for penetrating well casings and scoring the surrounding rock to facilitate hydraulic fractures. Particularly, it relates to methods and devices for making linear apertures in well casings, to methods for fracturing formations utilizing the linearly perforated well casings so made, and to the creation by directed explosives of linear notches in reservoir rock. Greater efficiency in fracturing is obtained through the use of the linear apertures of the invention, particularly in inclined, or deviated, wells. The invention can also be used to initiate fractures in open wells, or in bore sections in which no casing is placed.

BACKGROUND OF THE INVENTION

In petroleum and gas recovery, fractures are commonly created in reservoir rock surrounding a well in order to stimulate production rates. In order for the high pressure fracturing fluids to reach the rock, the casing of a well is perforated with explosive charges placed at the desired depths. The charges are generally shaped, designed and oriented to concentrate their force on single points, and accordingly tend to make circular holes or perforations in the casing and cement sheath. The holes are frequently small, i.e. typically one-fourth to one-half inch in diameter, which tends to cause large pressure drops when the fracturing fluid is forced into the well, reducing the effect of the hydraulic fracturing effort. Larger holes are not considered desirable because they tend to weaken the casing wall unacceptably. The pressure drop limits the flow rate and amount of fluid which can be forced into the formation during fracturing. Moreover, a relatively large number of perforations may frequently be used because of the aforesaid limitations, and the multiplicity of perforations results in relatively numerous small fracture initiation points having various orientations. This results in poor connection between the initiation points and the well bore, a condition sometimes called "near well bore tortuosity", and dissipates the pressure of the fracturing fluid in areas immediately around the well bore rather than extending relatively fewer, larger fractures. A single long fracture, rather than numerous small, tortuous fractures, is desirable.

While linear apertures have been made in well bores by abrasive fluids (see U.S. Pat. No. 5,335,724), we are not aware of the previous use of linear shaped charges, sometimes herein called linear charges, in the preparation of hydrocarbon recovery wells for fracturing. Linear charges themselves are not new. See, for example, Alford's U.S. Pat. No. 5,036,771, which describes a kit for assembling a linear charge to be used for demolition. Such charges are used in building implosions, underwater demolition, and elsewhere where it is desired to direct the energy of the charge to make a linear cut rather than a circular one or undirected explosion. The linear orientation of the charges described by Hayes in U.S. Pat. No. 4,881,445 is not the same—the patentee there suggests simply a string of spaced circular charges. Similar effects are obtained by the use of so-called bi-wire strip charges and hollow steel charge carriers commonly used in the art, both of which are designed for the emplacement of a series of spaced shaped charges for perforating the well casing with circular holes. These are not linear charges but merely orderly rows of circular charges, resulting in rows of spaced circular perforations. The technique known as overbalance perforating, using circular apertures—that is, conventional perforating charges—is described by Dees, Handren and Jupp in U.S. Pat. No. 5,131,472. In overbalance perforating, perforation is performed under high internal pressures and fracturing is begun immediately after perforation. When used herein, the term overbalance perforating, is intended to include the steps of pressurizing before perforating and fracturing immediately after perforating.

The hydrocarbon recovery art is in need of a technique and means for overcoming the disadvantages of conventional perforation of well casings.

SUMMARY OF THE INVENTION

Our invention is a method of creating apertures in well casings which comprises exploding one or more linear charges in the installed well casing. In a preferred method, we use a plurality of linear charges of desired lengths held within the charge carrier by stabilizers to maintain the strength of the carrier. The charges may be fired using conventional perforating firing heads, blasting caps and firing cords. The charge or charges may be oriented in a known manner to achieve directed linear apertures or slots. A well designed linear charge will go on to score the formation after cutting a slot in the casing and surrounding cement. In a preferred variation, our invention is employed in an inclined well, where it will profoundly affect the initiation of fractures during the hydraulic fracturing step. In another preferred variation, it is employed in the overbalanced perforating technique described by Dees, Handren and Jupp in U.S. Pat. No. 5,131,472, which is incorporated herein by reference. It is to be understood also that our invention includes a process which may be called "linear scoring", in that the linear charges described and used in the present invention may be employed in sections of well bore which do not have a casing.

DETAILED DESCRIPTION OF THE INVENTION

The basic concept of the invention is to cause linear apertures or slots to be made in the well casing by explosives, known herein as linear charges, prior to the application of pressurized fluid for formation fracturing. By linear apertures or slots, we mean holes which have a ratio of at least 4 to 1 in length to width and are at least one-quarter inch wide.

As is known in the explosives art, the force of an explosion can be directed in a linear fashion by shaping the explosive material into an elongated V shape, i.e. similar to an angle iron having a V profile. Detonation drives the inner metallic walls toward each other, resulting in a high velocity metallic jet directed precisely along the axis of the V. A preferred manner of using three such angled charges is illustrated in the accompanying drawings.

Figure 1:
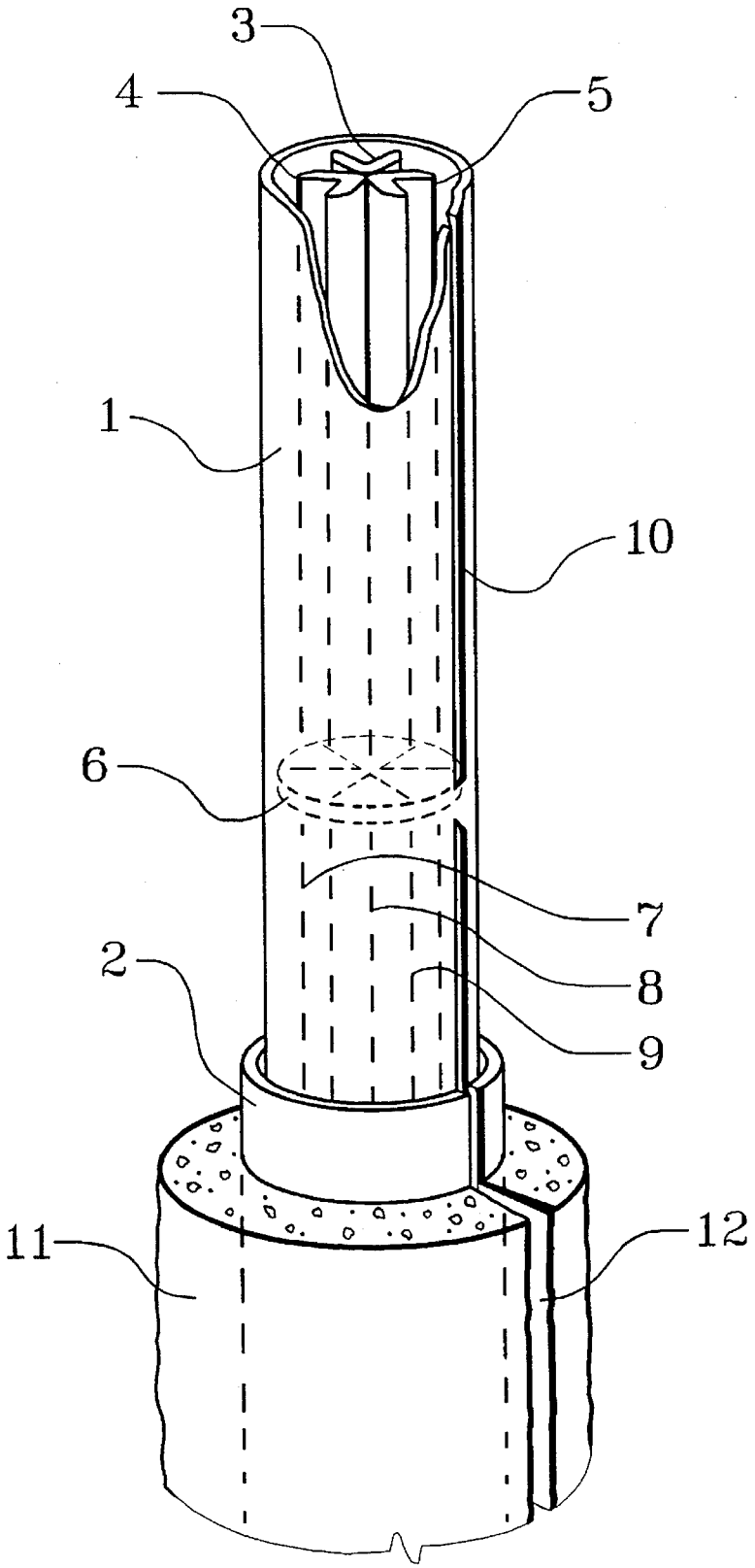
FIG. 1 is a truncated perspective of a tool body of our invention as it normally is placed for use in a well casing, showing the expected placement of one of the slots to be created.

In FIG. 1, the charge carrier 1 is shown placed in casing 2. Within the charge carrier 1 are three linear charges 3, 4, and 5 having angular profiles, each occupying about 120° and each occupying the full length of charge carrier 1. The angular charges 3, 4, and 5 are stabilized or held in place by stabilizer 6, and another set of three charges 7, 8, and 9 are shown partially below the stabilizer 6 supported by another stabilizer not shown. Also shown is slot 10 in the charge carrier 1 which will be made by angular charge 5 when it is exploded. The force of the charge is highly directed and will make a clean slot through the casing 2 and surrounding cement 11, as shown at 12.

Charge carrier 1 is a pressure-tight tube typically made of steel or aluminum, but may also be made of plastic or plastic composite, preferably high-strength, such as fiberglass reinforced polyester. As illustrated, the three 120° charges 3, 4, and 5 reinforce each other's direction, each forcing the other to concentrate the energy of the explosion into the centers of the V's of the respective charges, that is, on a line of force which bisects the V.

Figure 2:
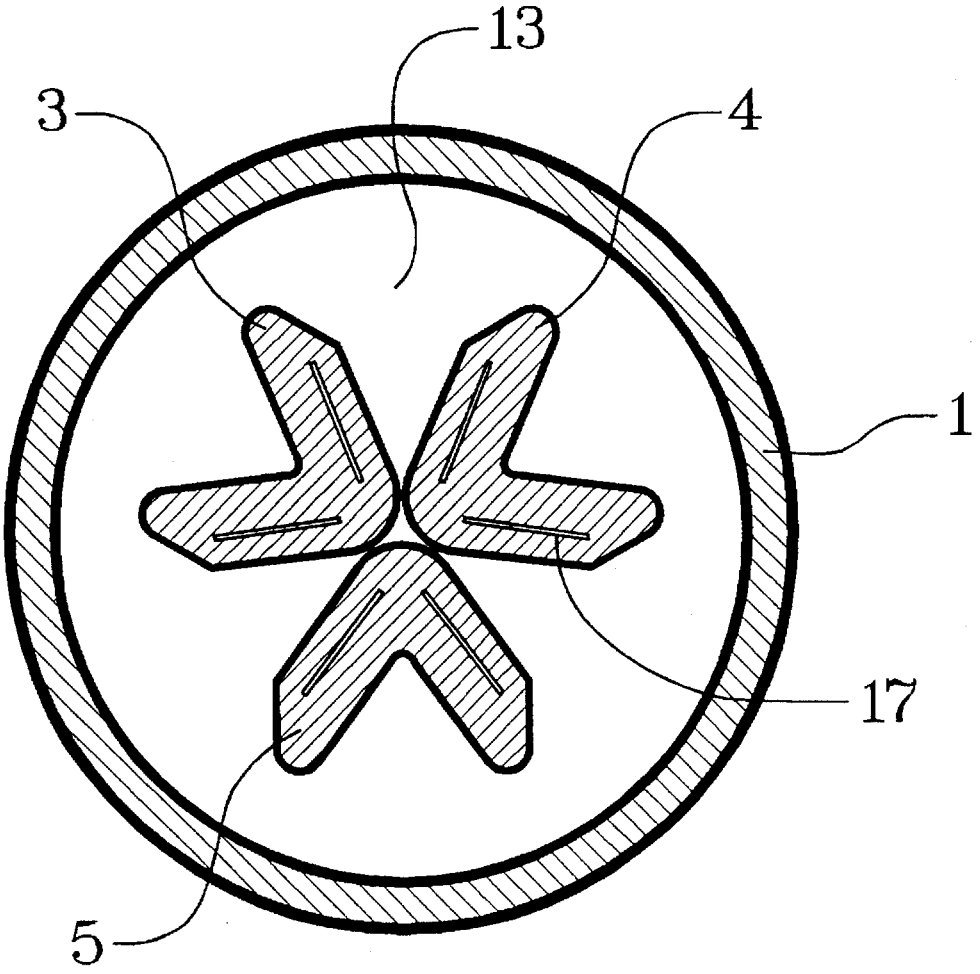
FIG. 2 depicts a section of a typical linear charge carrier (tool) showing charges deployed within the tool.

In FIG. 2, charges 3, 4, and 5 are shown placed in charge carrier 1. Area 13 may be occupied be air or any other material. Metallic strip inserts 17 add force and direction to the explosive effect.

Figure 3:
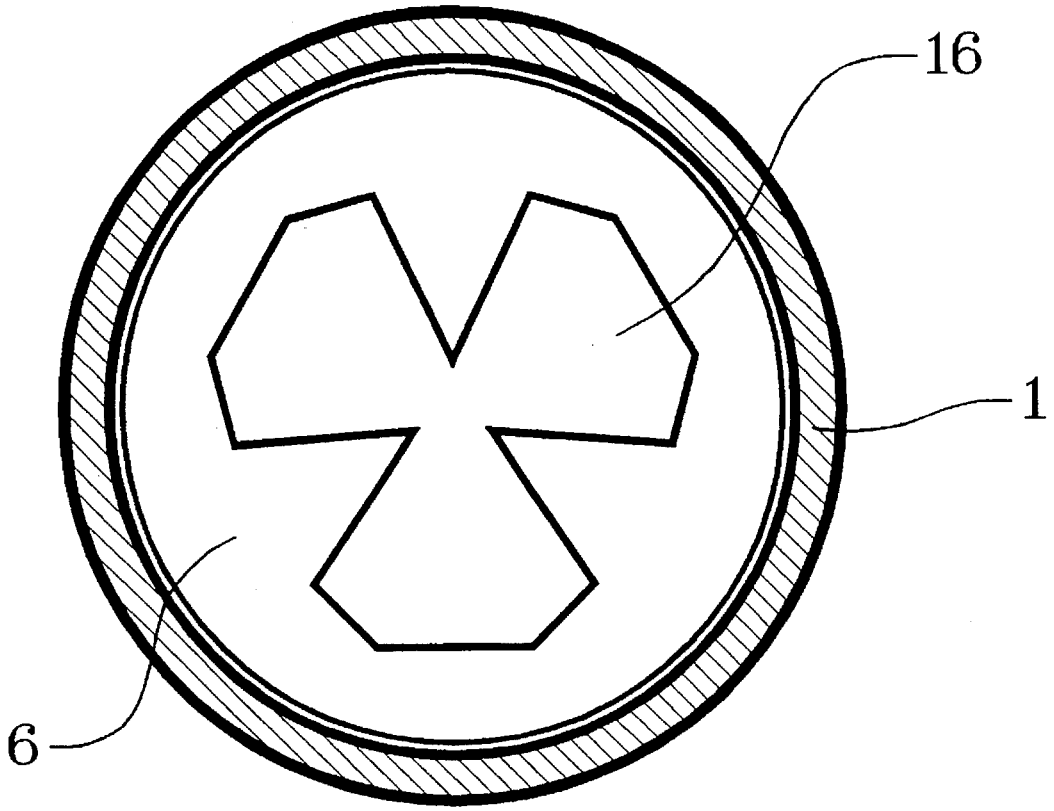
FIG. 3 shows a preferred variation of a stabilizer which may be built onto the end or at an intermediate point of the charge carrier. The stabilizer holds the charges and also functions as a charge interrupter.

FIG. 3 is an overhead view of stabilizer 6 showing its placement in charge carrier 1. This variation of stabilizer 6 has an opening 16 shaped to accommodate the three linear charges shown in FIG. 2—the linear charges may pass directly through the opening 16 or may terminate there and be held in place by friction.

Figure 4:
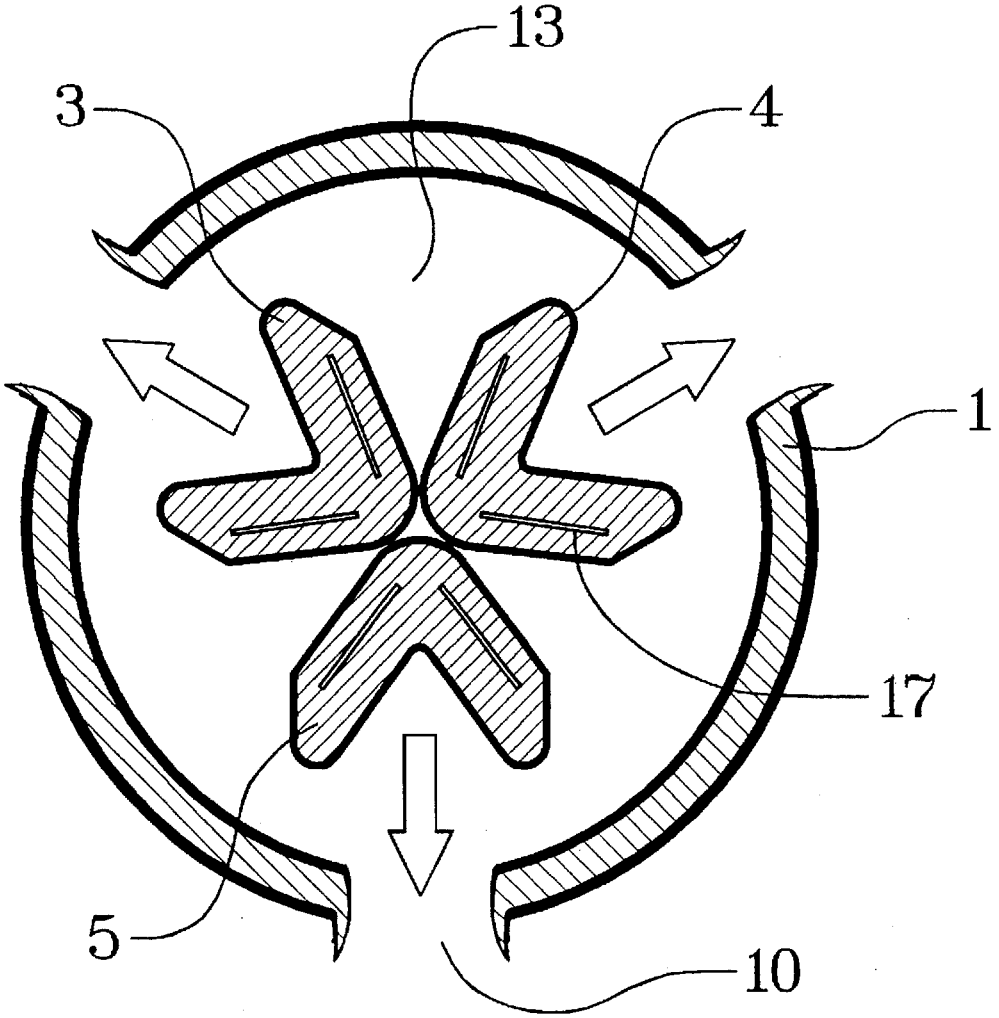
FIG. 4 is a sectional illustration of the effect of a detonation having three V-shaped charges.

FIG. 4 shows the effect of the explosive action of the linear charges, rupturing the casing 1 in the directions of the arrows from the centers of charges 3, 4, and 5 to make slots such as slot 10.

Figure 5:
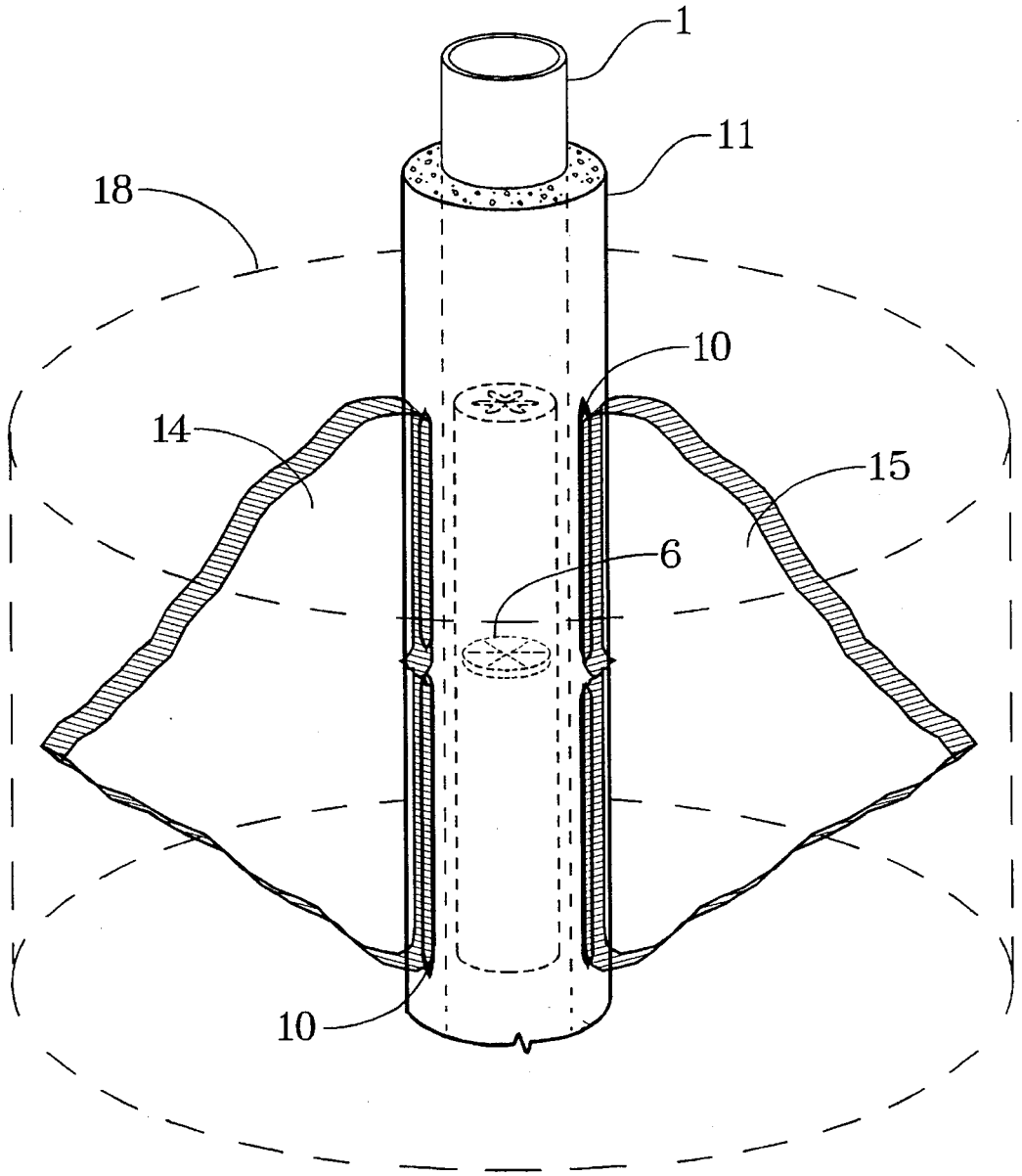
FIG. 5 is a more or less idealized depiction of formation fracture initiation from slots made in a casing according to our invention.

FIG. 5 is an idealized depiction of the relatively coherent and unitary fractures 14 and 15 made in formation 18 after fracturing through the slots 10 of our invention, having a minimum of tortuosity. Fracturing fluid and the energy used to fracture will tend not to be dissipated in relatively unproductive small, complex or tortuous fractures around the well bore.

Numerous other configurations of explosive materials will result in linear perforations. We do not intend to be limited to the particular shape illustrated herein, but intend to include within the scope of our invention the use of any explosive charge which will direct its explosive force, preferably in the form of a metallic jet, in a linear configuration. The charge should be effective to make a linear aperture in a well casing generally in alignment with or parallel to the well bore, following through where necessary with a similar aperture in any surrounding cement. A single V-shaped charge may be used. Shapes and orientations of explosive materials other than the Y configuration illustrated herein which are able to make linear perforations include star shapes and X shapes. The Y configuration illustrated herein will create three slots at approximately 120° intervals; the X shape will create four approximately equally spaced slots, and the star shape will create five. We do not intend to be limited to any particular number of slots in the circumference of the casing, however.

Our method employing linear charges may also be used where there is no casing in the well bore, to initiate fractures directly into the formation.

The length of the linear charges is limited only by the limitations of the manufacturing process, the practicalities of transportation, the mechanics of lowering the charge carriers in the well, and the like; as persons skilled in the art are aware, it is not uncommon to lower pipes as long as forty feet (about thirteen meters). We intend to include in our invention the creation and use of apertures as small as one-quarter inch by one inch. Such apertures will present the beneficial effects recited herein to a relatively small degree, but as a practical matter, we prefer that the apertures be at least about one foot (⅓ meter). The number of linear slots created in 360° of casing should be chosen keeping in mind the desirability of maintaining sufficient structural strength in the charge carrier; that is, the charge carrier should not be weakened to the point that it collapses or that it cannot be pulled out of the well. The charge carrier may be segmented into various lengths through the use of a plurality of spacers (stabilizers 6) as shown in the drawings. The spacers will assure some continuity in the casing and thus contribute to the maintenance of casing integrity, but any structure which will reinforce the charge carrier tube and/or stabilize the charges in a desired spaced relation in the charge carrier may be used. The presence of the stabilizer will assist in retaining some structural integrity in the charge carrier by tending to break up the linear slots. Our invention thus includes the linear charge device comprising a tubular sheath, a reinforcing member generally perpendicular to the axis of the sheath, and at least one charge which is supported by the reinforcing member. The reinforcing members, stabilizers or support plates may be spaced as desired through a more or less segmented length of charge device to accommodate a plurality of charges. It is to be understood that, throughout this specification, the terms "stabilizer" and "charge interrupter member" have the same meaning.

The explosive composition or material itself may be any of the conventional explosive materials now used for making circular perforations in the hydrocarbon recovery art, and/or which are used in the demolition art. Examples are RDX, HMS, HNS, and Pyx; these are designations which have achieved common usage in the art and are well known types of well perforating and/or demolition explosives.

Any known method of detonating the charges may be used, such as electronic or percussion detonators or exploding bridgewire detonators. Where a length of charge terminates and contacts a contiguous length of charge, one charge can be utilized to set off the next, preferably with a booster charge between, thus minimizing the number of blasting caps and firing cords which are necessary.

The charge carrier should be strong enough to withstand the hydrostatic pressures encountered in well bores and the hydraulic pressures of fracturing.

Our invention includes the method of fracturing a subterranean hydrocarbon bearing formation wherein at least one linear aperture, preferably a plurality of linear apertures, are made in well casing by lowering one or more linear charges into said well bore and exploding them at one or more desired depths, whereby one or more linear apertures are created in said well casing. Our invention is excellent for creating linear scoring in the cement and rock surrounding the well bore. A fracturing fluid forced into the well casing in a known manner will pass under pressure through the slots and, finding a coherent pattern or even a single scoring, into the formation, where it fractures the formation. In our method, the fracturing process utilizing linear apertures in the well casing is characterized by the minimizing of near well bore tortuosity.

Our invention has been demonstrated under test conditions.

EXAMPLE 1

A simulated well bore segment four feet in length was created by cementing a 10.5#/ft J-55 casing concentrically in a 12 inch diameter waxed cardboard (Sonotube) cylinder, using Portland Class A cement containing 3% calcium chloride. This was buried in gravel about one foot in depth. The charge carrier was a three inch diameter PVC pipe; two discs of ½" plywood were used to hold and stabilize the charge, which was a single linear charges of a strength 600 gr/ft. Three one-inch lengths of ¼" rod were attached to the ends and center of the charge to suppress the jet at these points, in an attempt to maintain strength of the casing. An inverted steel 55 gallon drum was set over the top of the exposed cemented pipe to help contain flying debris, and the device was detonated electrically.

The cement surrounding the 4½" casing was pulverized and the drum was bent and deformed, but not penetrated. The 4½" casing was slotted but expanded considerably, creating a slot measuring three inches wide at its widest point. The rods used to form the gaps in the slot appear to have worked, but the metal in the gap pulled apart due to the pipe expansion. The ends of the slot showed minimal growth past the ends of the charge. Only a small piece of the PVC pipe remained recognizable (about 1" wide and 2 inches long). Strips of copper remains of the linear shaped charge were found inside the 4½" casing. Evidence of the slot created by the charge was found on some of the larger remaining pieces of cement. The cement was cut to a depth of at least one half inch. The material past this depth was fractured and crumbled. Total penetration depth could not be determined.

EXAMPLE 2

The target configuration in this example was the same as in Example 1 except that sand was used to fill in the space between the cemented casing and the 55 gallon drum, in order to minimize casing expansion and damage to the cement. The linear shaped charge in this case were 900 gr/ft in strength. The charge carrier (or "gun") was a 3" ASTM A53 steel pipe about four feet long; plywood discs were used to center and stabilize the charge as in Example 1. ½" bolts were attached to the charge to create gaps in the slot. The charge was detonated electrically. The cement sheath around the 4½" casing was highly fractured and pulverized as in Example 1, but remained intact. There was no damage to the drum. The steel gun was swollen and stuck inside the 4½" casing. The spacers (bolts) created gaps in the slot in the gun, but, again, pipe expansion caused the pipe to fail at the gaps in the outer casing. The slot in the gun ranged from ¼" to ¾" in width. The slots in the casing ranged from 1 inch near the ends to 3½" at the widest part. Copper strips were mostly retained inside the gun. In addition to the slots created by the charge, the gun had numerous other cracks running the length of the pipe at various locations around the circumference of the pipe. It appeared that some of these were due to pipe expansion while others were initiated by an impact from charge material or secondary blasts from the charge.

It is clear from the above demonstrations that a linear charge will form a linear slot in a casing and penetrate a significant distance into surrounding cement, also with a linearly oriented force. The tests demonstrate also that shields such as the rods used in Example 1 and bolts in Example 2 will act to provide gaps in the slot where it is desired to provide them without a discontinuity of charge.

We claim:

1. Method of linearly scoring a hydrocarbon-bearing formation surrounding a well bore having a well casing comprising creating a linear aperture in said well casing in said well bore in said hydrocarbon-bearing formation by lowering a linear explosive charge in said well casing and exploding said charge, whereby a linear aperture is created in said well casing and said hydrocarbon-bearing formation adjacent to said linear aperture is linearly scored.

2. Method of claim 1 wherein said linear explosive charge has a profile in the shape of a V.

3. Method of claim 1 wherein said linear aperture has a ratio of length to width of at least 4.

4. A linear charge device for use in a well comprising a tubular sheath, at least one rigid reinforcing member generally perpendicular to the axis of said tubular sheath, and at least one linear charge supported by said reinforcing member.

5. The linear charge device of claim 4 containing a plurality of reinforcing members and linear charges.

6. The linear charge device of claim 4 wherein said reinforcing member includes means for centering said linear charge.

7. The linear charge device of claim 4 wherein three outwardly directed linear charges having V profiles are supported by a single reinforcing member.

8. A tubular linear charge device for creating slots in well casings comprising a tube including a plurality of segments defined by rigid charge interrupter members and linear charges supported thereby.

9. Method of fracturing a hydrocarbon-bearing formation surrounding a well bore to obtain a linear fracture in said formation and inhibit near well bore tortuosity comprising lowering a linear explosive charge into said well bore, exploding said linear explosive charge to form a linear score on said formation, and forcing a hydraulic fracturing fluid through said well bore to form at least one linear fracture.

10. Method of claim 9 wherein said linear explosive charge is oriented to direct the explosive force thereof to form a linear score on said formation generally parallel to said well bore.

11. Method of claim 9 wherein said charge is detonated electrically.

12. Method of claim 7 wherein said linear explosive charge is contained in a tubular carrier.

13. Method of claim 12 wherein said tubular carrier contains a plurality of linear charges.

14. Method of claim 9 wherein said well bore includes a casing, and said linear explosive charge creates a linear aperture in said casing.

15. Method of claim 14 including overbalance perforating.

16. Method of fracturing a subterranean formation surrounding a well casing comprising creating at least one linear aperture in said well casing generally longitudinal of said well casing by lowering a carrier containing a linear charge into said well casing, detonating said charge, and forcing a fracturing fluid therethrough to fracture said formation.

17. Method of claim 16 wherein said linear aperture has a ratio of length to width of at least 4.

18. Method of claim 16 wherein said aperture is at least about one foot long.

19. Method of fracturing a subterranean formation surrounding a well casing comprising creating, by overbalance perforating, at least one linear aperture in said well casing generally longitudinal of said well casing and forcing a fracturing fluid therethrough to fracture said formation.

* * * * *